US008281763B2

(12) United States Patent
Namikoshi

(10) Patent No.: US 8,281,763 B2
(45) Date of Patent: Oct. 9, 2012

(54) INTERNAL COMBUSTION ENGINE

(76) Inventor: Hiromichi Namikoshi, Hyogo (JP)

( * ) Notice: Subject to any disclaimer, the term of this patent is extended or adjusted under 35 U.S.C. 154(b) by 403 days.

(21) Appl. No.: 12/734,243

(22) PCT Filed: Jun. 23, 2009

(86) PCT No.: PCT/JP2009/002857

§ 371 (c)(1),
(2), (4) Date: Apr. 20, 2010

(87) PCT Pub. No.: WO2010/150307

PCT Pub. Date: Dec. 29, 2010

(65) Prior Publication Data

US 2012/0090571 A1 Apr. 19, 2012

(51) Int. Cl.
*F02B 75/32* (2006.01)

(52) U.S. Cl. ..... 123/197.1; 123/193.6; 74/52

(58) Field of Classification Search ..... 123/197.1, 123/193.6; 74/52
See application file for complete search history.

(56) References Cited

U.S. PATENT DOCUMENTS

| | | | | |
|---|---|---|---|---|
| 3,791,227 | A * | 2/1974 | Cherry | 74/52 |
| 4,073,196 | A * | 2/1978 | Dell | 74/52 |
| 4,970,995 | A * | 11/1990 | Parsons | 123/54.2 |
| 5,158,046 | A * | 10/1992 | Rucker | 123/65 R |
| 5,394,839 | A * | 3/1995 | Haneda | 123/53.1 |
| 5,983,845 | A * | 11/1999 | Yanagisawa | 123/53.1 |
| 6,024,067 | A * | 2/2000 | Takachi et al. | 123/197.1 |
| 6,526,935 | B2 * | 3/2003 | Shaw | 123/197.4 |
| 7,124,718 | B2 * | 10/2006 | Artola | 123/71 R |
| 8,161,932 | B2 * | 4/2012 | Li | 123/179.24 |
| 2001/0029922 | A1 * | 10/2001 | Dow | 123/197.1 |
| 2002/0185101 | A1 * | 12/2002 | Shaw | 123/197.4 |

FOREIGN PATENT DOCUMENTS

| | | |
|---|---|---|
| JP | 7-305601 | 11/1995 |
| JP | 2683218 | 11/1997 |

* cited by examiner

*Primary Examiner* — Noah Kamen
*Assistant Examiner* — Grant Moubry
(74) *Attorney, Agent, or Firm* — Jordan and Hamburg LLP

(57) ABSTRACT

A connecting member coupled to four pistons that reciprocate within cylinder bores is coupled to a crankpin of a crankshaft, and a pinion member which integrally rotates with a crankshaft portion is capable of rolling along the inner periphery of an internal gear member and has an outer diameter equal to ½ of an inner diameter of the internal gear member. The crankpin executes a reciprocating rectilinear motion through the rotation and revolution of the pinion member, and a journal support member has a bearing for supporting a crank journal so as to rotate positioned between the pinion member and a crank arm, and which is supported by a case member so as to rotate coaxially with an output member.

19 Claims, 13 Drawing Sheets

INTERNAL COMBUSTION ENGINE

BACKGROUND OF THE INVENTION

The present invention relates to an internal combustion engine that takes out rotational motion from an output shaft by converting the reciprocating rectilinear motion of a piston to rotational motion of a crankshaft, and more particularly relates to an internal combustion engine constructed so as to cause reciprocating rectilinear motion of a crankpin through a pinion member and an internal gear member coupled to the crankshaft.

A conventional reciprocating internal combustion engine is known that comprises a combustion chamber formed by a cylinder bore and a piston, a crankshaft including a crankpin off-centered from the axial center of the output shaft, and a connecting rod connected with the crankpin rotatably that oscillates according to the reciprocating rectilinear motion of the piston.

In the aforementioned engine, because the crankpin is formed in an eccentric position off-centered from the axial center of the output shaft by the length of the crank arm, the connecting rod reciprocates vertically while oscillating by a predetermined angle, and the reciprocating rectilinear motion of the piston is converted to rotational motion of the crankshaft, thereby the output shaft rotates.

Due to the structure causing the vertical movement and lateral oscillation of the connecting rod, the coupling part of the connecting rod and piston becomes a rotatively sliding part and the coupling part of the connecting rod and crankpin becomes a rotatively sliding part, and there are provided a plurality of rotatively sliding parts in a 4 cylinder type internal combustion engine. Further, side pressure is also acting on the 4 pistons due to the oscillation of the connecting rod.

The reason of low engine efficiency is generally recognized to be due to theoretical thermal efficiency. However, if the measured data of the source power and the shaft output are compared by performing an integration by multiplying the micro movement distance of the piston by the expansion force, it is easy to recognize that the problem is not limited to theoretical thermal efficiency.

Problems in conventional internal combustion engines include the problem of low thermal efficiency due to exhaust loss as well as the problem of significant loss due to friction and vibration, but many engineers believe that greater improvements is difficult.

As long as there is no change in the angular velocity of a rotating body, an external energy supply is not necessary, however, the general internal combustion engine for automobiles requires a large amount of energy. In other words, a great deal of fuel is consumed when racing including idling. The following shows the fuel consumption measured in P-mode with the air conditioner off with a 1700 ml displacement engine.

Fuel consumption corresponding to 10.4 kW at 1000 rpm
Fuel consumption corresponding to 17.6 kW at 2000 rpm
Fuel consumption corresponding to 26.4 kW at 3000 rpm
Fuel consumption corresponding to 35.2 kW at 4000 rpm
Fuel consumption corresponding to 47.2 kW at 5000 rpm Data of number of revolution and instantaneous fuel consumption have been compiled for an automobile during normal driving.

More specifically, for instance, when at 2000 rpm the instantaneous fuel consumption in running corresponds to 17.6 kW, the engine is considered to be an idle state without any output. In same manner when the fuel consumption at the same revolution number (rpm) is 30 kW, the difference of 12.4 kW mostly contributes to driving energy. In this case, only 12.4 kW (about 41%) of the 30 kW contributes to driving. However, actual axial output is lowered even more due to its thermal efficiency.

The results of 3 months of collecting this type of data show that 45% of fuel consumption is consumed in maintaining the revolutions of the engine while the remaining 55% is consumed for driving. For example, if the theoretical efficiency is 30%, then only 16% of the fuel consumption contributes to driving. Moreover, when transmission efficiency is added, the amount of contribution for driving becomes an even lower value.

Friction and vibration can be picked up as the cause for generating such conditions. Friction originating in the side pressure between the piston and the cylinder, friction between the piston pin and the connecting rod, friction between the connecting rod and the crankpin, and friction between the crankshaft and the housing can be picked up as such friction. Friction loss is viewed as inevitably increasing due to the inability to secure a sufficient oil film on the reciprocatively sliding parts and rotatively sliding parts.

As for vibration, although there is nothing to do for the vibration due to torque fluctuation in the expansion stroke, vibration in the rotating system cannot be ignored which ultimately becomes heat and is lost. Another problems except the rotating system is energy vibration. In a 4 cylinder engine, all the pistons and connecting rods repeat acceleration and deceleration simultaneously. Although kinetic energy of piston and connecting rod in the upper dead point and lower dead point is zero, at other times it has kinetic energy that is proportional to the square of the speed. Further, in a typical 4-cylinder engine, the four pistons lose speed simultaneously as well as accelerate simultaneously.

The acceleration described above repeats twice for every one rotation, and kinetic energy is given and received in continuous travel between the crankshaft and piston through the link mechanism including the connecting rod. Therefore, while generating vibrations which impact the angular velocity of the crankshaft, friction is generated at the same time in the four link mechanisms with the exchanged kinetic energy in each travel resulting in a large amount of energy loss.

The horizontally opposed 2-cylinder engine in patent document 1 (see FIG. 8) comprises a crankshaft that includes a main shaft for rotary output, a common connecting rod integrally coupled with a pair of horizontally opposing pistons, and a pair of planetary mechanisms equipped between the common connecting rod and the pair of crankpins, and each planetary mechanism comprises a sun gear (stationary internal gear) co-axial with the crankshaft and planetary gears having an outer diameter equal to ½ of the sun gear, and the planetary gears supported rotatably on the crankpin of the crankshaft, and a gear pin is integrally formed on the pair of planetary gears, and coupled to the common connecting rod.

When a piston in the engine described above moves in reciprocating rectilinear motion, there is no oscillating action in the connecting rod and no side pressure on the piston because the gear pin coupled to the common connecting rod moves on the horizontal plane including the rotation axial center of the crankshaft in an reciprocating rectilinear motion according to the roll of the planetary gears.

Patent Document 1: Japanese Patent Publication No.: 2683218

The horizontally opposed 2-cylinder engine of patent document 1 does not have a structure that supports both ends of the common gear pin with bearings but rather supports with a pair of planetary gears and has a structure that supports each of these planetary gears with the crankpins of the crankshaft.

Therefore, when a large load applied from the piston acts on the gear pin, the crankpin experiences elastic deformation rendering the gear meshing defective between the planetary gears and the sun gear increasing friction, destabilizing operational reliability, and sacrificing the durability of the planetary gears. Furthermore, supporting the gear pin described above with bearings becomes difficult because the gear pin moves with reciprocating rectilinear motion in the parallel direction with the axial center of the piston.

SUMMARY OF THE INVENTION

An object of the present invention is to provide an internal combustion engine in which the crankpin moves with reciprocating rectilinear motion and capable of securing support rigidity and durability in the crankshaft and the surroundings thereof, and to provide a highly efficient internal combustion engine capable of realizing remarkably low fuel consumption and small size.

The present invention presents an internal combustion engine, comprising a piston capable of sliding within a cylinder bore and a crankshaft coupled operatively through a connecting member to the piston, and capable of converting reciprocating motion of the piston into rotational motion of the crankshaft to output from an output shaft, wherein; the crankshaft comprises a crankpin coupled to the connecting member, a pair of crank arms and a pair of counter weights, a pair of crank journals, and at least one crankshaft portion which extends coaxially from at least one crank journal Said internal combustion engine, further comprises: at least one output member supporting the crankshaft rotatably around a rotary axial center off-centered from an axial center of the output shaft and being formed integrally with the output shaft and supported by the case member rotatably coaxially with the output shaft; at least one internal gear member having a plurality of internal gear teeth formed coaxially with the output member and being fixed to the case member; at least one pinion member having an outer diameter equal to ½ of an inner diameter of the internal gear member and engaging so as to be capable of rolling along an inner periphery of the internal gear member, said pinion member being fitted externally on the crank shaft portion rotatably integrally with the crankshaft portion in a position adjacent to the crank journal; and a pair of journal support members having respective bearings to support a pair of crank journals rotatably around an axial center off-centered from the axial center of the output shaft and being supported by the case member rotatably coaxially with the output member; and the internal combustion engine converting the reciprocating motion of the piston into rotation and revolution of the pinion member, and converting the revolution of the pinion member into rotation of the output member to be output as rotational power from the output shaft.

According to the internal combustion engine of the present invention, because the pinion member has the outer diameter equal to ½ of the inner diameter of the internal gear member and is capable of rolling along the inner periphery of the internal gear member, and is externally mounted so as to integrally rotate with the crankshaft portion, the crankpin moves in an reciprocating rectilinear motion through the pinion member and the internal gear member when the crankshaft has rotational motion due to the reciprocating rectilinear motion of the piston member. In this manner, the reciprocating motion of the piston is converted to rotation and revolution of the pinion member through the internal gear member and the crankshaft, and the revolution of the pinion member is converted into rotation of the output member, thereby enabling the rotational power from the output member to be output as rotation of the output shaft supported by the case member.

A structure coupling the crankpin and the connecting member can be simplified, the structure and enables the output properties and vibration properties of an internal combustion engine can be improved to significantly reduce friction loss, because there is no rotatively sliding parts in the coupled part of a connecting member and piston and the coupled part of a connecting member and crankpin, and because there is no side pressure on the piston.

As there are provided one pair of journal support members having respective bearings to support one pair of crank journals so as to rotate around a axial center off-centered from the axial center of the output shaft and being supported by a case member so as to coaxially rotate with the output member, rigidity, strength, and durability can be secured in a structure for supporting the crankpin because the pair of crank journals at both ends of the crankpin are supported at both ends by a pair of bearings and journal support members.

In addition, the distance between the bearings and the crankpin can be shortened and the crank journal can be effectively supported with a compact journal support member including the bearings described above. Additionally, because the pinion member can be supported by the crank journal and crankshaft portion at both ends, rigidity, strength, and durability can be secured in a structure for supporting the pinion member.

The following constitution may also be adopted, as appropriate, in addition to the above constitution.

(1) The crankpin moves with reciprocating rectilinear motion parallel to the axial center of the cylinder bore when a piston reciprocates within the cylinder bore.
(2) The output member comprises a bearing supporting the crank shaft portion rotatably at an opposite position from the journal support member in relation to the internal gear member, and the journal support member comprises a bearing supporting rotatably the crank journal positioned between the crank arm and the pinion member.
(3) The internal combustion engine has a plurality of cylinder bores and pistons arranged in an opposing manner on both sides of the crankshaft, and a plurality of connecting members connected with the plurality of pistons are integrally formed.
(4) The connecting member has a ring-shaped connector externally mounted on the crankpin so as to rotate and a plurality of straight connectors coupled to the plurality of pistons; and at least a portion of the straight connectors among the plurality of straight connectors is fixed to the ring-shaped connector.
(5) The plane that includes the center lines of the plurality of pistons is arranged orthogonal to the crankpin.
(6) The plane that includes the center lines of the plurality of pistons is arranged parallel to the crankpin.
(7) The balancer weight is integrally equipped to the output member.
(8) The off-centering amount of the crankpin in relation to the crankshaft portion is set to ½ of the outer diameter of the pinion member.
(9) The balancer weight is formed at the opposite side from the pinion member in relation to the axial center of the output shaft in the inner space of the internal gear member.

DESCRIPTION OF THE NUMERALS

Figure 1:
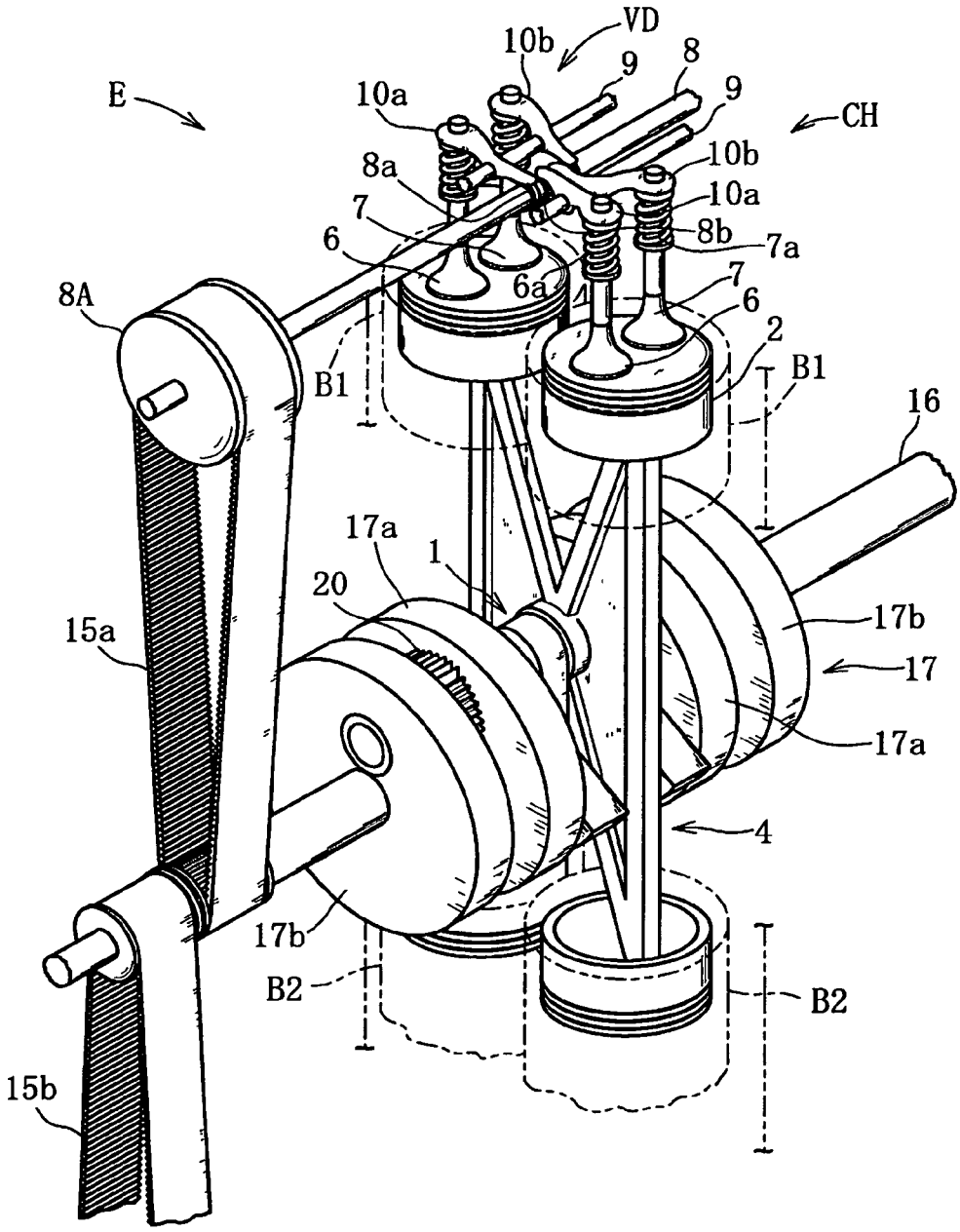
FIG. 1 is a perspective schematic view of an engine (housing omitted state) according to Embodiment 1 of the present invention.

E, EA engine
B1, B2 cylinder bore
H housing (case member)
1, 1A crankshaft
1*a*, 1Aa crankpin
1*b* crank journal
1*c* crank arm
1*d* crankshaft portion
1*e* counter weight
2 piston
4, 4A connecting member
4*a*, 4Aa ring-shaped connector
16 output shaft
17*a* journal support member
17 output member
17*b* crankshaft support portion
17*c* balancer weight
19 internal gear member
20 pinion member

DESCRIPTION OF THE PREFERRED EMBODIMENTS

A mode for carrying out the present invention will be explained hereinafter based on embodiments.

Embodiment 1

Engine E according to Embodiment 1 will be explained hereafter based on FIG. 1 through FIG. 11.

Figure 2:
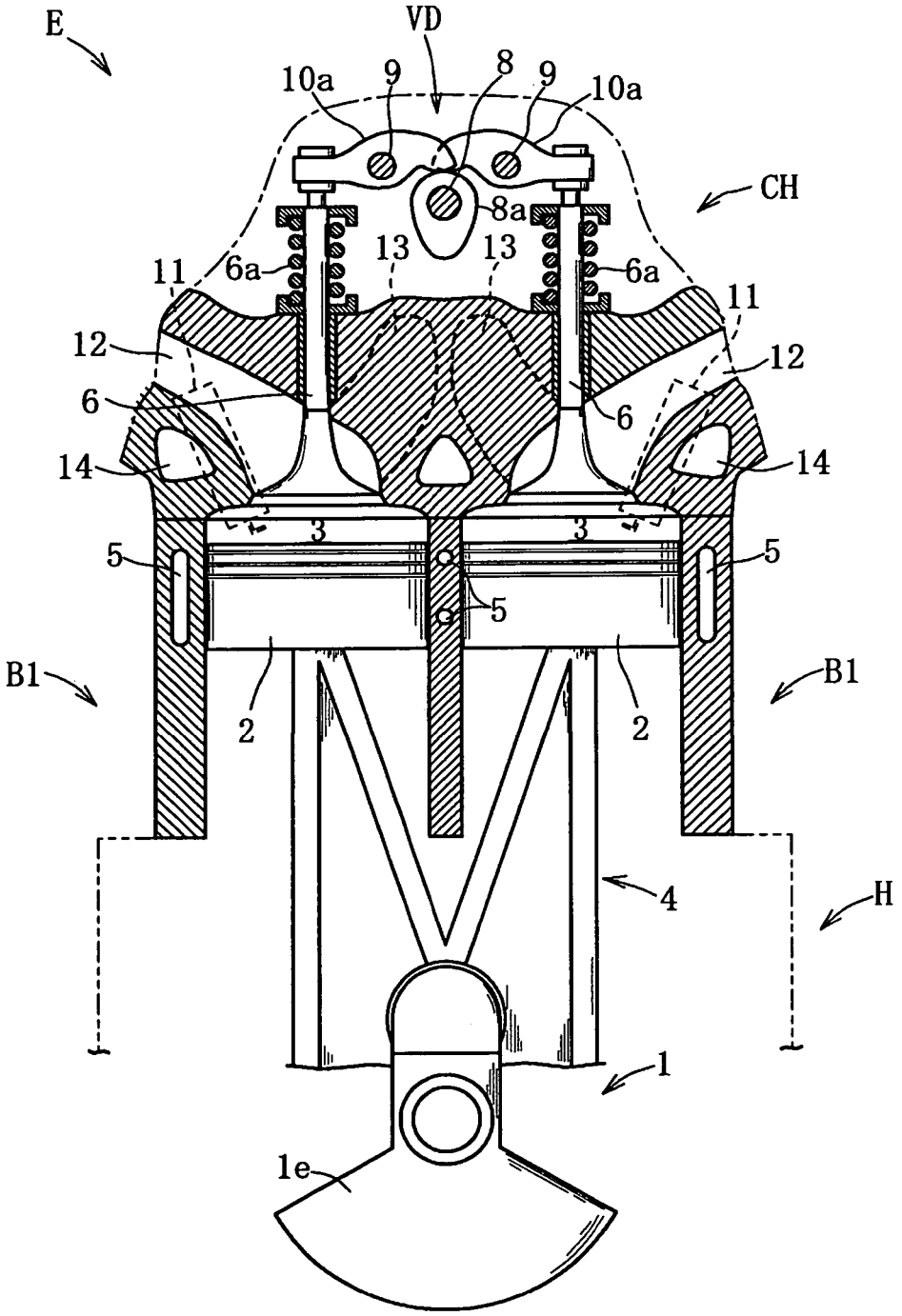
FIG. 2 is a sectional view of the main portion of the engine.
Figure 3:
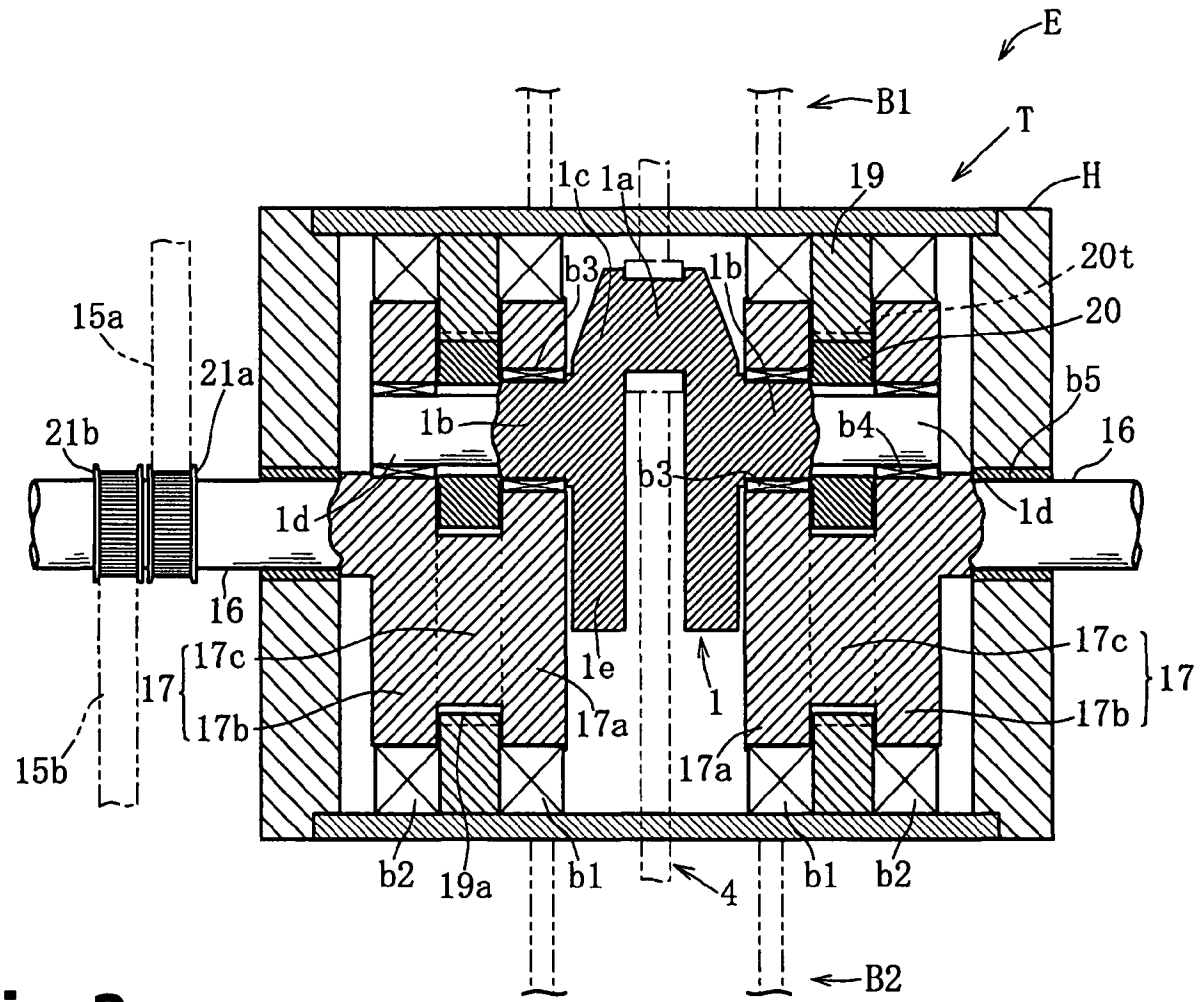
FIG. 3 is a cross sectional view of a crankshaft, a pinion member, an internal gear member, an output member and a journal support member.

As shown in FIG. 1 to FIG. 3, engine E is a vertically opposed type 4-cylinder four cycle reciprocating internal combustion engine. Engine E comprises a housing H as a case member, a pair of cylinder bores B1 formed at the upper part of the housing H and a pair of cylinder bores B2 formed at the lower part of the housing H, a top cylinder head CH that covers the top of the cylinder bores B1 and a bottom cylinder head CH that covers the bottom of the cylinder bores B2, a pair of pistons 2 mounted so as to slide in the pair of cylinder bores B1, a pair of piston 2 fitted so as to slide in the pair of cylinder bores B2, a valve driving mechanism VD, an X-type connecting member 4 that is coupled to the four pistons 2, an output taking out mechanism T including the crankshaft 1 that is connected operatively to the connecting member 4.

Output member 17 etc., including the crankshaft 1 and an output member 17 including an output shaft 16 is supported rotatably by the housing H. The pair of top cylinder bores B1 and the pair of bottom cylinder bores B2 are vertically opposed, and the axial centers of the vertically opposed cylinder bores B1 and B2 are co-axial. The pair of top cylinder bores B1 are formed in an adjacent manner and the pair of bottom cylinder bores 2 are also formed in an adjacent manner. A common plane including the axial centers of the four cylinder bores B1, B2, in other words, the common plane including the axial centers of the four pistons 2 is perpendicular to the axial center of the crankshaft 1 and the axial center of the output shaft 16. In this engine E, for example, the diameter of the piston 2 is set to 60 mm, the stroke is set to 125 mm, and the total displacement is set to approximately 1400 ml.

Pistons 2 are provided in the cylinder bores B1 and B2 respectively so as to executes reciprocating rectilinear motion, and combustion chambers are formed respectively by the cylinder bores B1, B2, cylinder head CH, and pistons 2. The piston 2 is formed so that the length is shorter than the diameter. Four pistons 2 are coupled to the crankpin 1*a* of the crankshaft 1 through the x-type connecting member 4.

Because the connecting member 4 executes a linear motion in a vertical direction, there is no side pressure against the pistons 2. Therefore, the skirt part of the piston 2 may be formed extremely short, or the skirt part may be omitted.

The structure of the upper half of engine E and the structure of the lower half of engine E are nearly vertically symmetrical except for the crankshaft 1, and therefore, the following description will be mainly given regarding the structure of the upper half of engine E and the output taking out mechanism T including the crankshaft 1. As shown in FIG. 2, a water jacket 5 where coolant water is introduced from a water pump (not shown) is formed within a surrounding inner wall area of the combustion chamber 3 in the housing H.

An air intake port 12 and an air intake valve 6 that are communicated to the combustion chamber 3 of each cylinder bore, and an exhaust port 13 and an exhaust 7 that are communicated to the combustion chamber 3 are arranged in a parallel direction to the axial center of the crankshaft 1. The air intake valve 6 and the exhaust valve 7 are each supported by a valve guide and are capable of moving in the valve axis direction, and are energized in the valve closing direction by valve springs 6*a*, 7*a* that are interposed between a spring retainer and a spring sheet.

The cylinder head CH is provided with a pair of injectors (not shown) capable of injecting fuel into a pair of combustion chambers 3, a pair of ignition plugs 11, a pair of air intake passages that are communicated to a pair of air intake ports 12, an exhaust passages that is communicated to a pair of exhaust ports 13, and a water jacket 14 where coolant is introduced.

Next, brief descriptions will be given on the valve driving mechanism VD which drives so as to open and close by a preset timing while the air intake valve 6 and the exhaust valve 7 are synchronized with the crankshaft 1.

The cylinder head CH is provided with a camshaft 8 arranged at the top of a mid-position between the pair of cylinder bores B1 while extending in parallel to the axial center of the crankshaft 1, and a pair of rocker-arm shafts 9.

A pair of intake cams 8*a* and a pair of exhaust cams 8*b* are formed in the middle section of the camshaft 8. The intake cam 8*a* and the exhaust cam 8*b* that correspond to one side combustion chamber 3 are formed on the camshaft 8 so that the intake cam 8*a* and the exhaust cam 8*b* that correspond to the other side combustion chamber 3 can be interposed between the two. The camshaft 8 is supported rotatably by the cylinder head CH.

A pair of rocker-arm shafts 9 is arranged in parallel to both the left and right side of the upper vicinity of the camshaft 8. These rocker-arm shafts 9 is provided with a pair of intake rocker-arms 10*a* that corresponds to the pair of intake cams 8*a*, and a pair of exhaust rocker-arms 10*b* that corresponds to the pair of exhaust cams 8*b*. The middle section of the intake rocker-arm 10*a* is supported rotatably by the rocker-arm shaft 9, the lower surface of one end abuts the intake cam 8*a*, and the lower surface of the other end abuts the valve shaft end of the air intake valve 6. The air intake valve 6 is driven up and down via the intake rocker-arm 10*a* by the intake cam 8*a* that integrally rotates with the camshaft 8. The exhaust rocker-arm 10*b* is also composed in the same manner, and the exhaust valve 7 is driven up and down via the exhaust rocker-arm 10*b* by the exhaust cam 8*b* that integrally rotates with the camshaft 8.

As shown in FIG. 1 and FIG. 2, a cam pulley is mounted on one end of the camshaft 8. A timing belt 15*a* that is driven to rotate by the crankshaft 1 is suspended from the cam pulley 8A. When the timing belt 15*a* drives the cam pulley 8A to rotate, the intake cam 8*a* and the exhaust cam 8*b* formed at the camshaft 8 are driven to rotate, the air intake valve 6 is opened and closed by the preset timing by the intake cam 8*a* and intake rocker-arm 10*a*, and the exhaust valve 7 is opened and closed by the preset timing by the exhaust cam 8*b* and the exhaust rocker-arm 10*b*. Here, in the state as shown in FIG. 2 in the upper half of engine E, for example, the left cylinder is positioned at a compression upper dead point, and the right cylinder is positioned at an exhaust upper dead point. At that time, in the lower half of engine E, for example, the left cylinder is positioned at an intake lower dead point and the right cylinder is positioned at an expansion lower dead point.

This engine E is a rocker-arm engine having one camshaft 8 and two rocker-arm shafts 9 for two cylinder bores B1, however, it may be also composed as an SOHC engine. Each camshaft corresponding to each cylinder bore B1, B2 may be respectively provided and each camshaft may be provided with an intake cam, an exhaust cam and cam pulley as a DOHC engine.

Next, descriptions will be made on the output taking out mechanism T including the crankshaft 1.

As shown in FIG. 3, the output taking out mechanism T is provided with a crankshaft 1, a pair of output members 17 that is integrally formed with the output shaft 16 so as to rotate coaxially with the output shaft 16, a pair of journal support members 17*a*, a pair of internal gear members 19 formed coaxially with the output shaft 16 and fixed on the housing H, and a pair of pinion members 20 that is engaged with the internal gear member 19 so as to roll along the inner periphery of the internal gear member 19.

Figure 4:
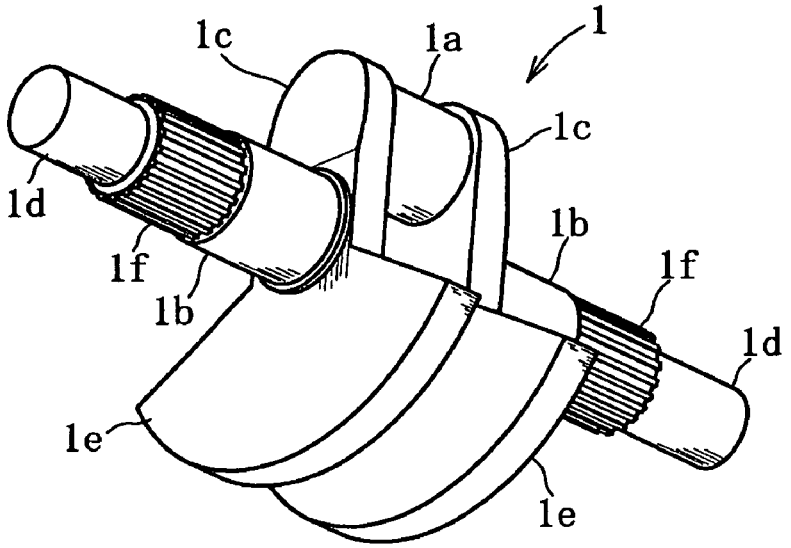
FIG. 4 is a perspective view of the crankshaft.
Figure 5:
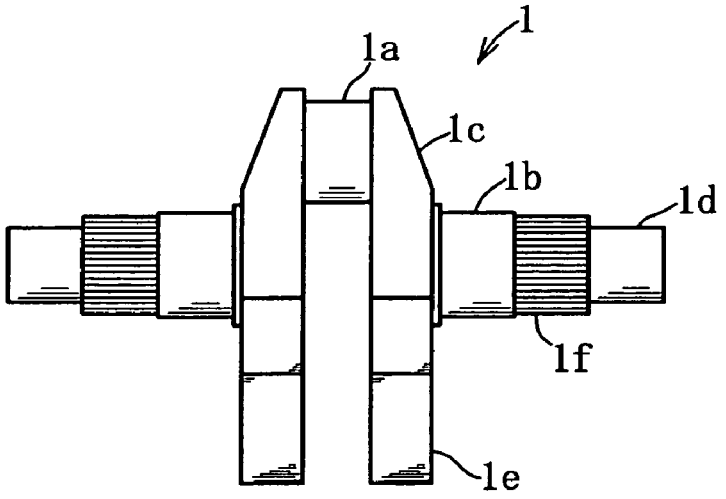
FIG. 5 is a side view of the crankshaft.
Figure 6:
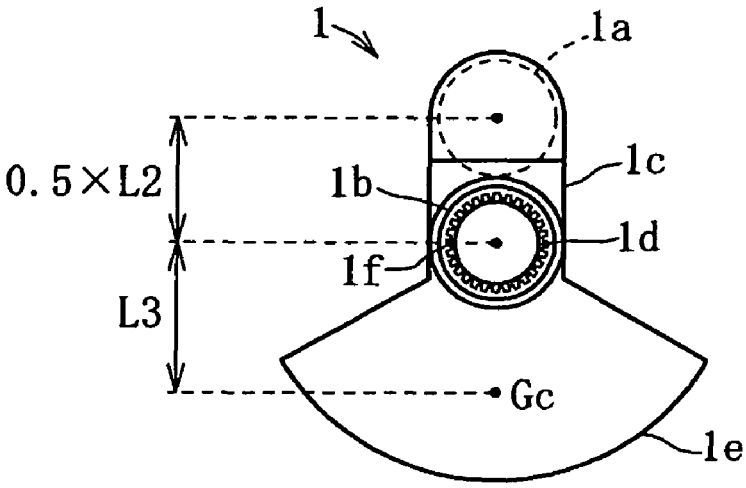
FIG. 6 is a frontal view of the crankshaft.

As shown in FIG. 4 to FIG. 6, the crankshaft 1 is provided with a crankpin 1 centrally placed in the longitudinal direction and coupled with the connecting member 4, a pair of crank journals 1*b* that is formed in parallel to the crankpin 1*a* and supported by the housing H so as to rotate the crankshaft 1, a pair of crank arms 1*c* connecting both ends of the crankpin 1*a* to a pair of crank journals 1*b* respectively, a pair of crankshaft portion 1*d* having a smaller diameter than the crank journals 1*b* and which extend in the longitudinal direction from the crank journal 1*b*, a pair of counter weights 1*e* that is integrally formed with the crank arm 1*c* and which extend in the opposite direction from the crankpin 1*a* in relation to the crank journal 1*b*, and the like. Crankshaft 1 is formed laterally symmetrical to the crankpin 1*a* in FIG. 3.

The base part of the crank journal 1*b* side of the crankshaft portion 1*d* is formed to be a spline shaft 1*f* having a predetermined length, a spline shaft bore is formed at the center part of the pinion member 20, and the pinion member 20 is fitted so as to integrally rotate on the spline shaft 1*f*. The diameter of the spline shaft 1*f* is formed smaller than the diameter of the crank journal 1*b* and larger than the diameter of the crankshaft portion 1*d*.

Figure 11:
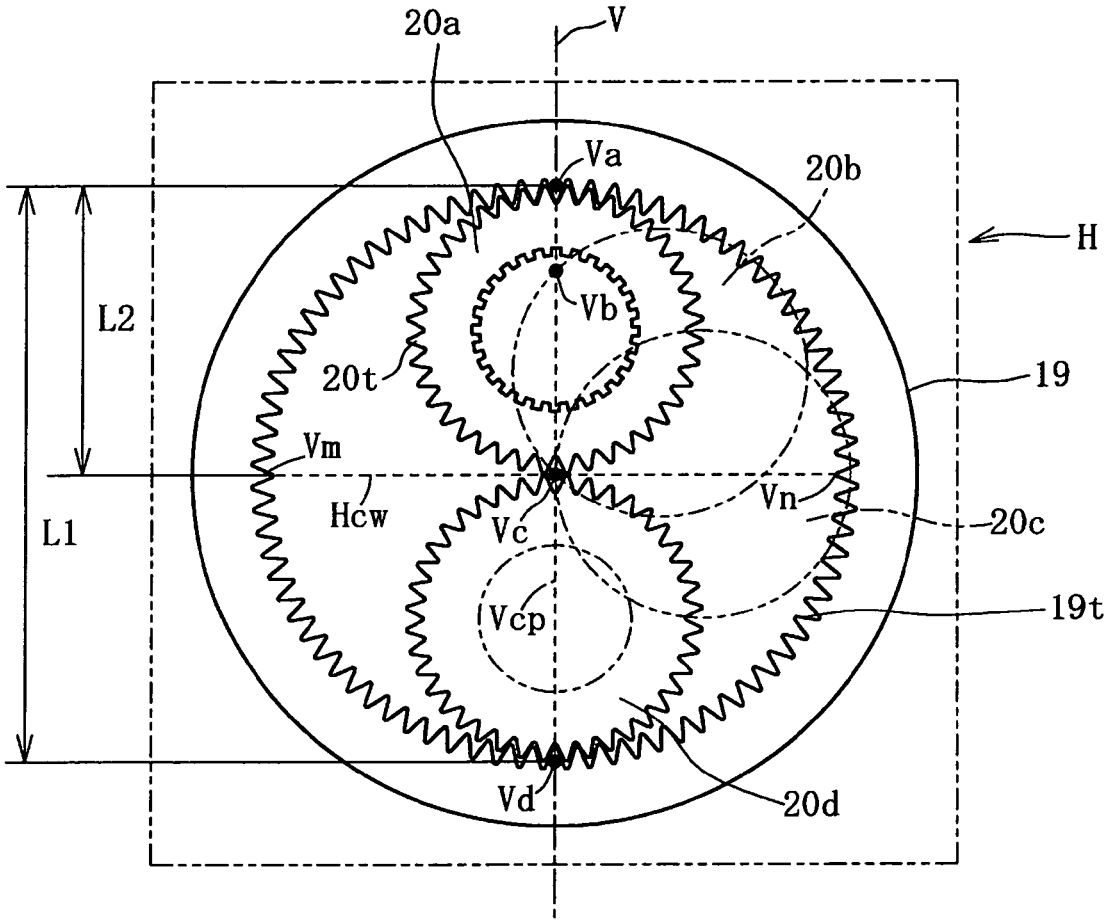
FIG. 11 is an operation explanatory drawing of the crankshaft, pinion member and internal gear member.

As shown in FIG. 3 and FIG. 11, when the inner diameter of the internal gear member 19 (pitch circle diameter) is L1 and the outer diameter of the pinion member 20 (pitch circle diameter) is L2, then L1=2×L2, and the axis of the crank journal 1*b* and the crankshaft portion 1*d* is off-centered by 0.5×L2 from the axial center of the output shaft 16, and crankpin 1*a* is off-centered by 0.5×L2 from the axial center of the crank journal 1*b* and the crankshaft portion 1*d*. As shown in FIG. 6, the gravity center Gc of the counterweight 1*e* is off-centered by L3 (=0.5×L2) from the axial center of the crank journal 1*b* and crankshaft portion 1*d*.

Output shaft 16 is integrally formed at the end of each output member 17. Output shaft 16 is supported rotatably on the housing H through a bearing b5. Each output member 17 is supported by the housing H through bearing b2 so as to rotate freely. Each output member 17 is formed integrally with the crankshaft support portion 17*b* and balancer weight 17*c*. Journal support member 17*a*, having a bearing b3 for supporting the crank journal 1*b* so as to freely rotate between the crank arm 1*c* and the pinion member 20, is equipped in an adjacent position to the crank arm 1*c* and the counterweight 1*e* in each output member 17, and the journal support member 17*a* is integrally formed with the output member 17.

Crankshaft support portion 17*b*, having a bearing b4 supporting the crankshaft portion 1*d* rotatably, is formed at the opposite end from the journal support member 17*a* in relation to the internal gear member 19 for each output member 17. Balancer weight 17*c* that couples the journal support member 17*a* and the crankshaft support portion 17*b* is integrally formed in the area that corresponds to the internal gear member 19 for each output member 17. The journal support member 17*a* and the crankshaft support portion 17*b* are formed in a disc shape centered on the axial center of output shaft 16, the journal support member 17*a* is supported by the housing H by the bearing b1, and the crankshaft support portion 17*b* is supported so as to freely rotate by the housing H (case member) by the bearing b2.

The balancer weight 17*c* is formed on a sectional semicircle member that passes through the inner space of the opposite side from the pinion member 20 in relation to the axial center of the output shaft 16 in the inner space of the internal gear member 19. In addition, even if integrally structuring the journal support member 17*a* and the output member 17, it is preferable that the interface between the journal support member 17*a* and the output member 17, or the interface between the balancer weight 17*c* and the crankshaft support portion 17*b*, are integrally structured so as to be separated into parts in order to permit assembly. For example, the journal support member 17*a* may be a different member from the output member 17, and combined integrally with the balancer weight 17*c* by a plurality of bolts.

As shown in FIG. 3, the output shaft 16 of the output member 17 of one side outputs a driving force and the output shaft 16 of the output member 17 of the other side takes out the driving force to drive the valve gear VD and auxiliaries. Accordingly, sprockets 21*a*, 21*b* engage with timing belts 15*a*, 15*b* respectively are set to have a diameter equal to ½ of the diameter of the cam pulley 8A, and a pulley (not shown) for driving auxiliaries are mounted at the end portion of the output shaft 16 of output member 17 of the other side.

As shown in FIG. 3, the ring-shaped internal gear member 19 is fixed onto the housing H between the bearing b1 and the bearing b2. The internal gear member 19 has a plurality of inner teeth 19 capable of engaging with outer teeth 20*t* of the pinion member 20, and provides a plurality of inner teeth 19*t* arranged in a ring shape coaxially with the axial center of the output member 17. The outer teeth 20*t* of the pinion member 20 are capable of rolling along the inner teeth 19*t*.

Figure 10:
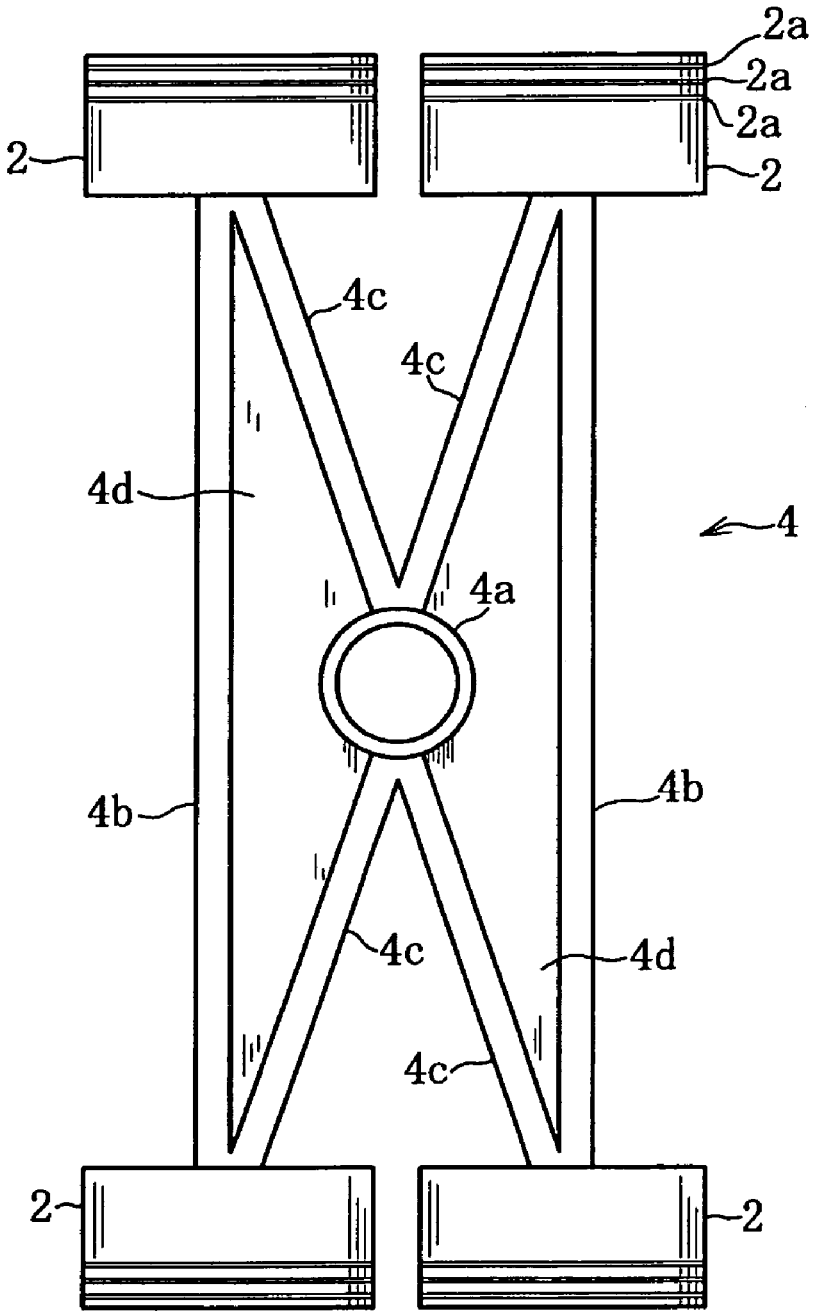
FIG. 10 is a front view of a piston and a connecting member.

As shown in FIG. 1 and FIG. 10, the connecting member 4 comprises a ring-shaped connector 4*a* that is externally mounted on the crankpin 1*a* so as to rotate, a pair of outer straight connecting members 4*b* arranged in parallel sandwiching the ring-shaped connector 4*a* while coupling integrally four pistons 2 opposing each other in the vertical direction, four inner straight connecting members 4*c* for coupling the upper ends and lower ends of each outer straight connecting member 4*b* and the ring-shaped connector 4*a* in the region inside of a pair of outer straight connecting member 4*b*, and a pair of triangle-shaped thin wall parts 4*d* as reinforcement provided in the region surrounded by the ring-shaped connector 4*a*, the outer straight connecting member 4*b*, and the inner straight connecting members 4*c*.

Each of upper side connecting portions of the outer straight connecting member 4*b* and the inner straight connecting member 4*c* is coupled rigidly or movably to the central portion of the piston 2 in the upper cylinder bore B1. Each of lower side connecting portions of the outer straight connecting member 4*b* and the inner straight connecting member 4*c* is coupled rigidly or movably to the central portion of the piston 2 in the lower cylinder bore B2. The vertically opposing upper and lower pistons 2 are coupled directly by the outer straight connecting member 4*b*, and upper and lower pistons 2 that are not vertically opposed are coupled by the ring-shaped connector 4*a* and two inner straight connecting members 4*c*. In addition, three piston rings 2*a*, for example, are fitted to the periphery of the piston 2.

When four pistons 2 reciprocate in the vertical direction, the pinion member 20 rotates on its axis once according to the rotation of crankshaft 1 while revolving once on the inner teeth 19*t* of the internal gear member 19, and crankpin 1*a* can have reciprocating rectilinear movement along the vertical plane including the center of the rotating axis of the output shaft 16 associated with the rolling of the pinion member 20.

When one of the upper pistons 2 is positioned at the compression upper dead point, as shown in FIG. 11, the pinion member 20 is positioned at the position 20*a* that corresponds to the upper end of the inner teeth 19*t*, and the axial center of the crankpin 1*a* is positioned at the upper end position Va. When a compressed air fuel mixture is ignited by spark plug 11, the expansion stroke of combustion gas is initiated. When the crankpin 1*a* is pressed downward in the expansion stroke, the pinion member 20 is moved to the position 20*b* by rolling in the right direction on the inner teeth 19*t*. At that time, the axial center of the crankpin 1*a* is positioned midway Vb on the vertical line V as a result of the combined movements of the rotational motion of the rotary axial center and the rolling motion on the inner teeth 19*t* by the pinion member 20.

When the pinion member 20 is positioned at the position 20*c* by rotating 180 degrees, the axial center of the crankpin 1*a* is positioned at the mid position Vc by performing further downward motion along the vertical line V. When the piston 2 reaches the lower dead point and the pinion member 20 rotate 360 degrees, the pinion member 20 is placed at the position 20*d* that corresponds to the lower end position of the inner teeth 19*t*, and the axial center of the crankpin 1*a* is positioned at the lower end position Vd.

In the exhaust stroke, the pinion member 20 revolves along the inner teeth 19*t* from the lower end position 20*d* to the upper end 20*a*, and the axial center of the crankpin 1*a* moves in a reverse direction from the expansion stroke (combustion stroke) on the vertical line V. The above description was given as an example when piston 2 in one cylinder carries out up and down motion in the order of the upper dead point, lower dead point, and upper dead point; however, this is also the same even when other pistons 2 carry out up and down motion in the order of upper dead point, lower dead point, and upper dead point. This engine E is a 4-cycle four-cylinder engine, and therefore, the four strokes of air intake stroke, compression stroke, expansion stroke, and exhaust stroke are conducted in parallel in four cylinders, and the four strokes of air intake stroke, compression stroke, expansion stroke, and exhaust stroke are conducted in order in each cylinder.

The engine E is constituted so as to balance mass distribution (unbalanced moment) in relation to the center of rotation (axial center of crankshaft portion 1*d*) of the pinion member 20, and also to balance mass distribution (unbalanced moment) in relation to the center of rotation (axial center of the output member 17) of the output shaft 16.

Figure 8:
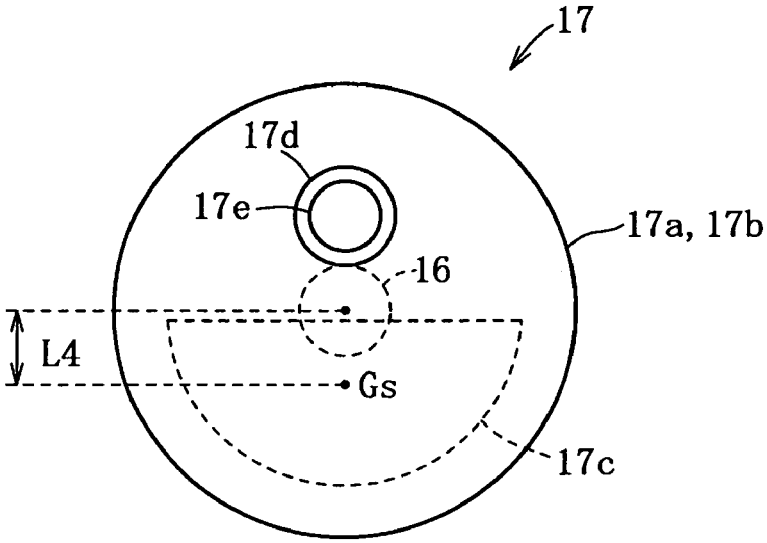
FIG. 8 is a front view of the output member.
Figure 9:
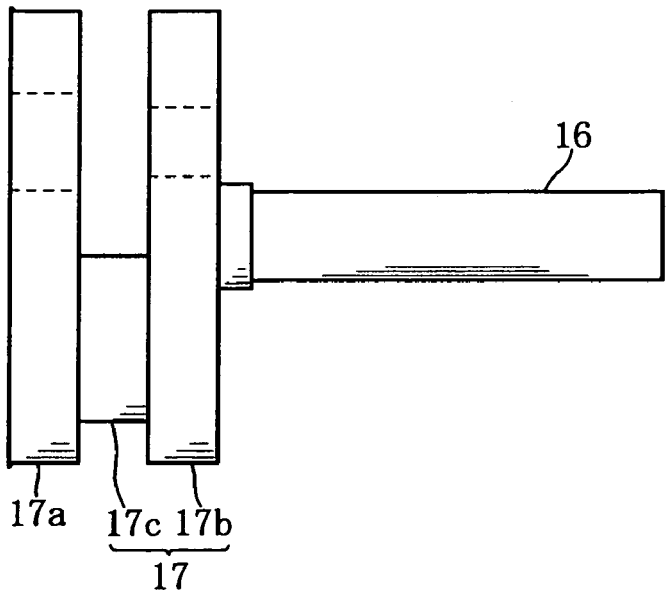
FIG. 9 is a side view of the output member.

Thereby, as shown in FIG. 6 and FIG. 8, when the distance from the axial center of the crankshaft portion 1*d* to the center of gravity Gc of the counter weight 1*e* is L3 and the distance from the axial center of the output shaft 16 to the center of gravity Gc of the balancer weight 17*c* is L4, the distance L3, distance L4, mass W1*e* of counter weight 1*e* and mass W17*c* of the balancer weight 17*c* are set so as to hold the following relations.

$$(W2+W4)\times 0.5\times(L2)=W1c\times L3 \quad (1)$$

$$((W2+W4)+W1e+W20)\times 0.5\times(L1-L2)=W17c\times L4 \quad (2)$$

Moreover, W2 is the mass of 4-pistons 2, W4 is the mass of connecting member 4, and W20 is the mass of a pair of pinion members 20. The mass and distance of each member are set so as to satisfy equations (1) and (2) which enables the mass balance of reciprocating components, including the piston 2 and connecting member 4 and rotating components including the reciprocating components, counter weight 1*e* and pinion member 20, to be balanced.

In FIG. 11, while the engine E operates as described above, the crankpin la moves in reciprocating rectilinear motion along the line segment Vcp between the upper end position Va and the lower end position Vd, and the speed and kinetic energy of the four pistons 2 and connecting member 4 reach maximum at the mid position Vc and minimum at the upper end position Va and lower end position Vd. On the other hand, the center of gravity Gc (refer to FIG. 6) of the counter weight 1*e* moves in reciprocating rectilinear motion along the line segment Hcw that is orthogonal to the line segment Vcp, and the speed and kinetic energy of two counter weights 1*e* reach minimum at the left end position Vm and the right end position Vn, and reach maximum at the mid position Vc. Furthermore, when the crankpin 1*a* is at the upper end position Va or the lower end position Vd, the center of gravity Gc of the counter weight le reaches the mid position Vc, and when the crankpin 1*a* is at the mid position Vc, the center of gravity Gc of the counter weight 1*e* reaches the left end position Vm or the right end position Vn.

Therefore, in this engine E, when considering with the exception of power by combustion gas pressure, that the sum of the kinetic energy of oscillating rectilinear motion in a vertical direction of four pistons 2 and connecting member 4 and the kinetic energy of reciprocating rectilinear motion in a horizontal direction of the center of gravity Gc of two counter weights 1*e* is nearly uniform, and a transfer or exchange of kinetic energy is conducted between the kinetic energy of the reciprocating rectilinear motion in a vertical direction and the kinetic energy of the reciprocating rectilinear motion in a horizontal direction. Therefore, the kinetic energy released as engine vibrations and thermal energy can be remarkably reduced and output properties can be considerably improved.

Figure 7:
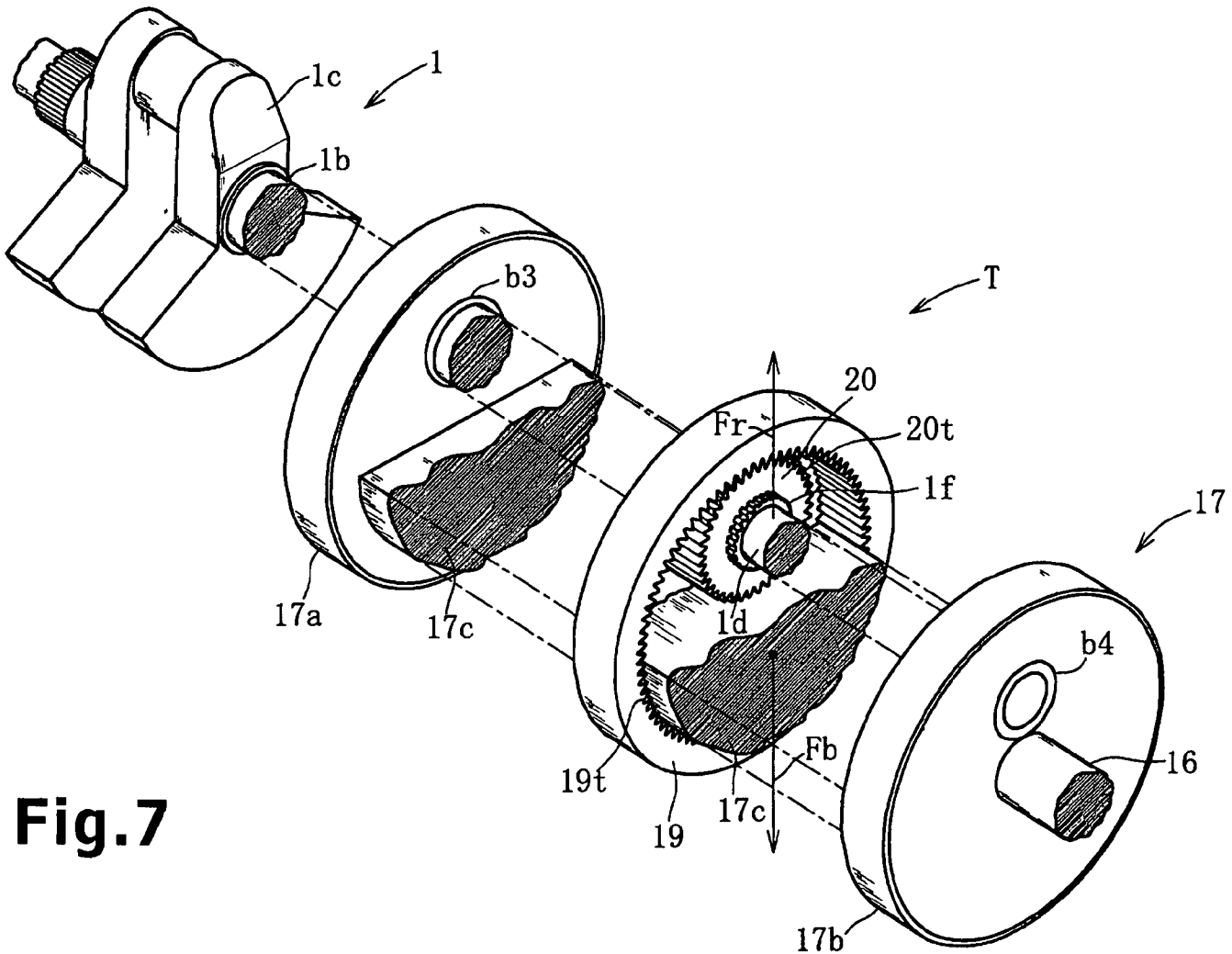
FIG. 7 is an exploded perspective view of the crankshaft, internal gear member, pinion member and output member.

Next, descriptions will be made on dynamic balancer function of the balancer weight 17*c*. As shown in FIG. 7, while the engine E is running, the crankshaft 1, pinion member 20 etc. rotates around the axial center of the output shaft 16, so centrifugal force Fr occurs. Meanwhile, the balancer weight 17*c* also rotates around the axial center of output shaft 16, so centrifugal force Fb occurs. Here, because the balancer weight 17*c* is positioned on the opposite side of the pinion member 20, the centrifugal force Fb cancells the centrifugal force Fr and engine vibrations are remarkably reduced. Still more, the size of the balancer weight 17*c* is set in advance so as to cancell the centrifugal force Fr by the centrifugal force Fb.

Next, a description is given on the operation and advantages of the present engine E. With this engine E, the output member 17 supports crank shaft portion 1*d* so as to rotate around the axial center off-centered from the axial center of the output shaft 16, and supported by the housing H so as to coaxially rotate with the output shaft 16, and therefore rotational motion of the crank shaft portion 1*d* can be output from the output shaft 16.

Because internal gear member 19 is coaxially formed with the output member 17 and fixed to the housing H, the pinion member 20 can rotate according to the rotational motion of the crank shaft portion 1*d*. Because the pinion member 20 has the outer diameter L2 equal to ½ of the inner diameter L1 of the internal gear member 19, and is capable of rolling along the internal periphery of the internal gear member 19, and because the pinion member 20 is externally mounted on the crank shaft portion 1*d* so as to integrally rotate, and is positioned adjacent to the crank journal 1*b*, the pinion member 20 is capable of rolling along the internal periphery of the internal gear 19 while the crankpin 1*a* executes reciprocating rectilinear motion. In such a manner, the reciprocating motion of piston 2 can be converted to rotation and revolution of the pinion member 20 through the crankshaft 1 and internal gear member 19 while the revolution of pinion member 20 can be converted to rotation of the output member 17 and journal support member 17*a*, and the rotation of the output member 17 and journal support member 17*a* can be output as the rotation of output shaft 16.

Journal support member 17*a* has a bearing b3 that supports rotatably the crank journal 1*b* positioned between the pinion member 20 and crank arm 1*c* on the housing H so as to integrally rotate coaxially with the crankshaft support portion 17*b*, and therefore, the crank journal 1*b* adjoined to the crankpin 1*a* can be supported by the bearing b3, and the crank journal 1*b* can be supported on the housing H by the bearing b1 through the journal support member 17*a*. Accordingly, the support rigidity and strength for supporting the crank journal lb can be secured thereby assuring durability.

Because the locus of motion of the crankpin la can be regulated in reciprocating rectilinear motion by the internal gear member 19 and pinion member 20, side pressure does not act from the connecting member 4 to the piston 2, and friction resistance exerting on the piston 2 can be remarkably reduced. Further, the structure for connecting the crankpin la and the connecting member 4 can be simplified, and because there is no rotatively sliding portion for coupling the connecting member 4 with piston 2 and crankpin 1*a*, friction resistance for coupling the connecting member 4 significantly reduced, fuel consumption rate can be remarkably minimized, fuel consumption can be remarkably reduced, and thereby the output properties and vibration properties of the engine E can be improved.

As a result of providing the bearing b3 for supporting the crank journal 1*b* positioned between the pinion member 20 and crank arm 1*c* so as to rotate on the journal support member 17*a* that is integral with the output member 17, the crankpin 1*a* can be supported at both ends by a pair of crank journals 1*b* and bearings b3, and therefore, the structural rigidity, strength, and durability for supporting the pinion member 20 can be secured.

Because the connecting member 4 comprises a ring-shaped connector 4*a* that is externally fit to the crankpin 1*a* so as to rotate, and the ends of a plurality of inner straight connecting members 4*c* that are coupled respectively to a plurality of pistons 2 are fixed to the ring-shaped connector 4*a*, the plurality of inner straight connecting members 4*c* coupled to the plurality of pistons 2 can be coupled to a crankpin 1*a* through the ring-shaped connector 4*a*. As a result of arranging the plane including the center line of the plurality of pistons 2 orthogonal to the crankpin 1*a*, a short crankpin 1*a* can be used. As a result of arranging four pistons 2 symmetry to the axial center of the output shaft 16, a compact engine E can be realized.

Because the bearing b3 is arranged at a position off-centered from the axial center of the output shaft 16, and the journal support member 17*a*, crankshaft support portion 17*b* and balancer weight 17*c* are formed integrally, the balancer weight 17*c* for generating balance moment around the axial center of the output shaft 16 is provided at the output member 17, vibrations, noises, and the like of the engine E can be significantly reduced. As a result of setting the amount of off-centering of the crankpin 1*a* in relation to the crankshaft portion 1*d* to ½ of the outer diameter L2 of the pinion member 20, the locus of motion of the crankpin 1*a* can be set securely to reciprocating an oscillating rectilinear motion.

Embodiment 2

Figure 12:
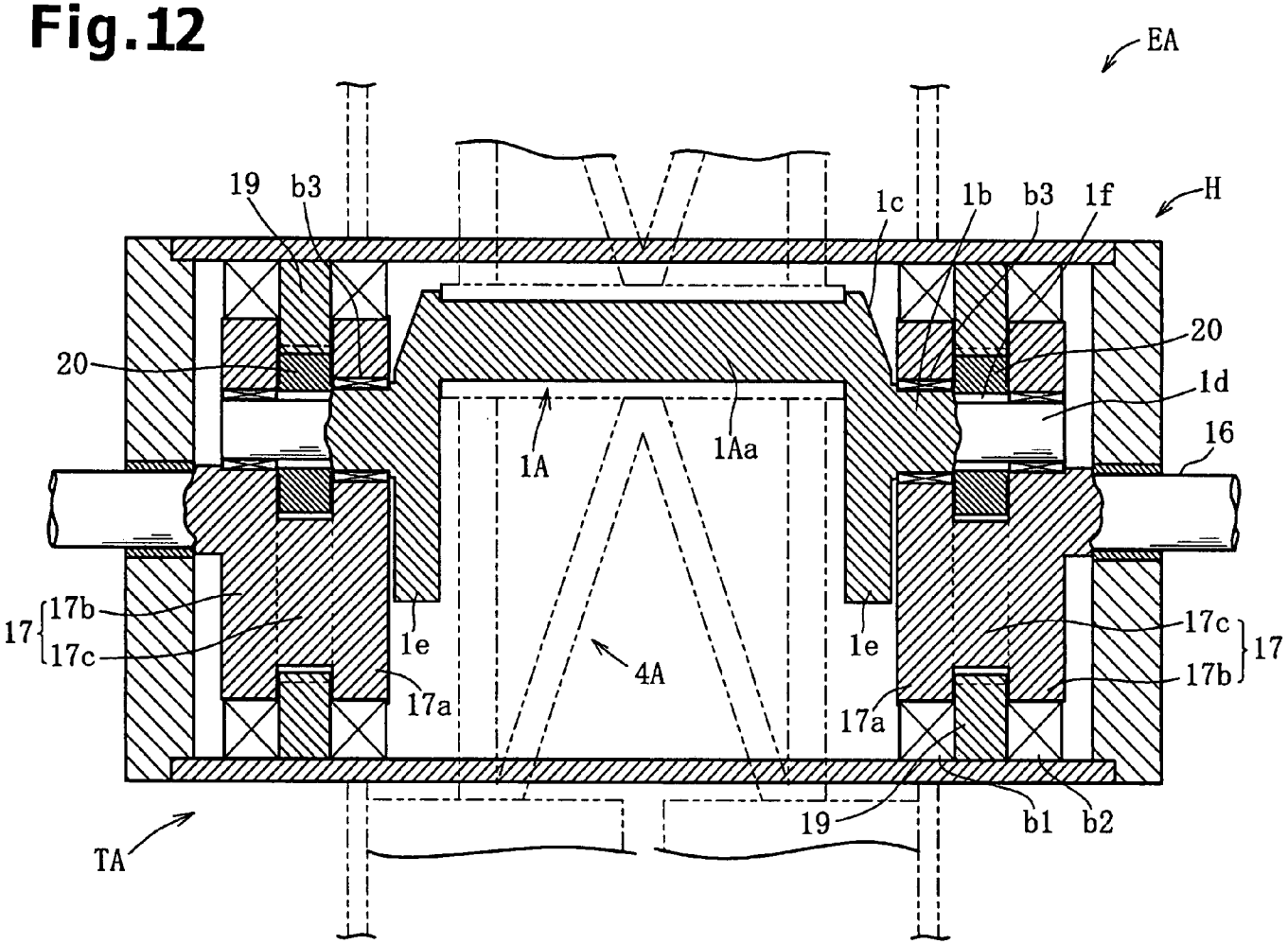
FIG. 12 is a corresponding drawing to FIG. 3 according to Embodiment 2.

Next, descriptions will be made based on FIG. 12 and FIG. 13 regarding engine EA according to Embodiment 2. The following descriptions will only relate to composition differing from engine E of Embodiment 1 and will omit descriptions by attaching the same reference numerals for the same components as Embodiment 1.

The engine EA, for example, is an engine of horizontally opposed type. The engine EA is constituted so that the horizontal plane including the axial center of the four pistons 2 is a common horizontal plane with the horizontal plane including the axial center of the output shaft 16. Crankshaft 1A has a crankpin 1Aa coupled to the connecting member 4A formed on the midway in the length direction, a pair of crank journals 1*b*, a pair of crank arms 1*c*, and a pair of crankshaft portion 1*d* with a diameter smaller than the crank journal 1*b*, a pair of counter weights 1*e* extending in the opposite direction as the crank pin 1Aa in relation to the crank journal 1*b* integrally formed with the crank arm 1*c*. As shown in FIG. 12, crankshaft 1A has a structure of lateral symmetry in relation to the crank pin 1Aa.

Figure 13:
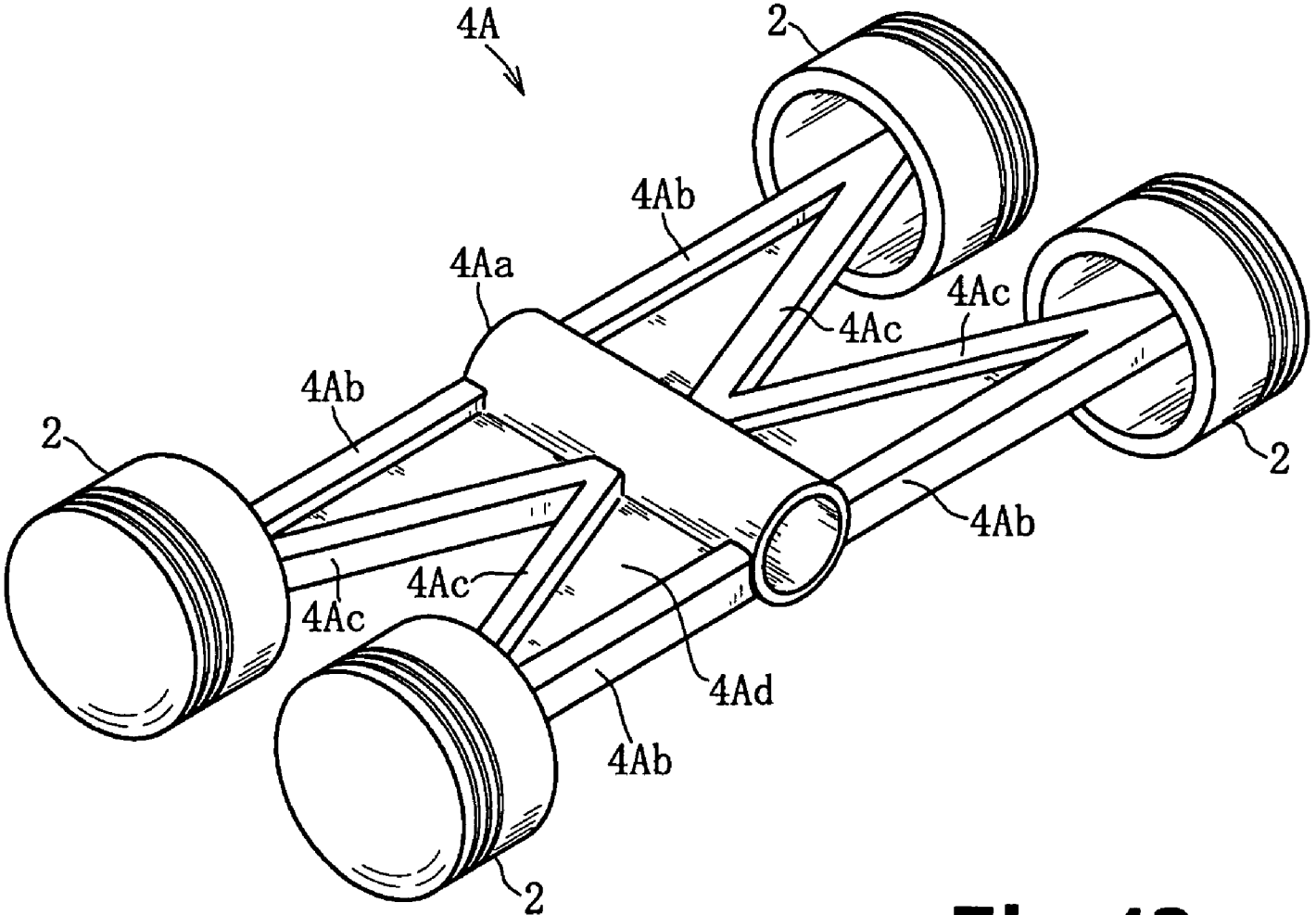
FIG. 13 is a perspective view of a piston and a connecting member.

As shown in FIG. 13, connecting member 4A comprises a ring-shaped connector 4Aa that is externally fit to the crankpin 1Aa so as to rotate, two pairs of left and right outer straight connecting members 4Ab arranged straightly in parallel with sandwiching the ring-shaped connector 4Aa as well as connecting the mutually opposed pistons 2 in a lateral direction in FIG. 13, four inner straight connecting members 4Ac that connect the ring-shaped connector 4Aa with the end of each of the outer straight connecting members 4Ab, and a triangle shaped thin wall part 4Ad provided in the area surrounded by the ring-shaped connector 4Aa, the outer straight connecting member 4Ab, and the inner straight connecting member 4Ac for increasing the rigidity of the connecting member 4A.

Next, descriptions will be made on the action and advantages of engine EA. The same advantages will be achieved with engine EA as with Embodiment 1. Additionally, because the plane including the center line of the four pistons 2 is arranged parallel to the axial center of the crankpin 1A, the overall height of the engine EA can be decreased to be small. Engine EA then becomes favorable as an automotive engine.

Embodiment 3

Figure 14:
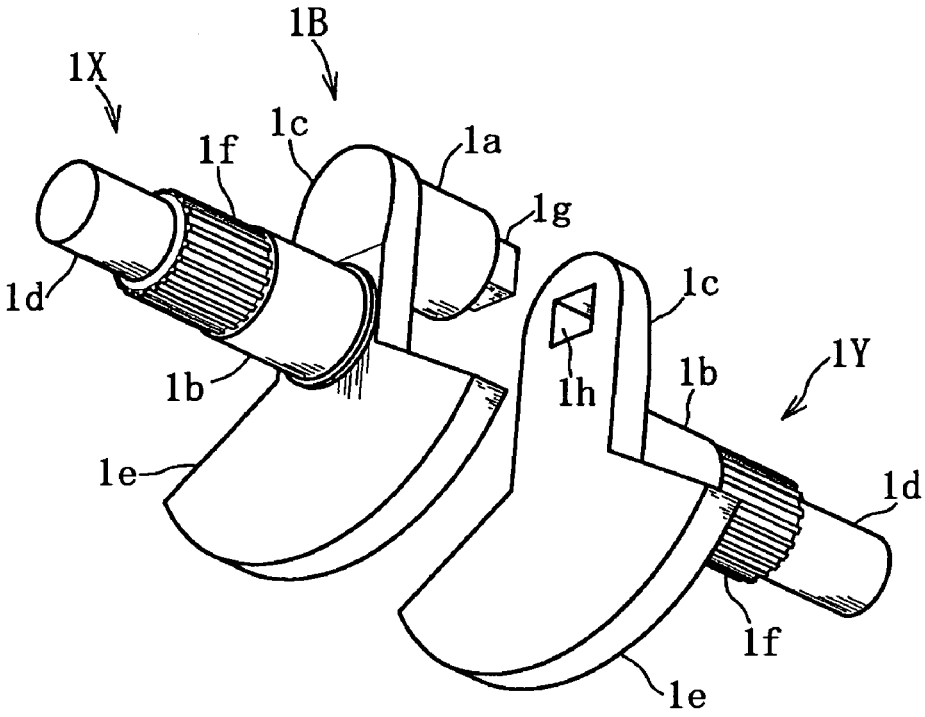
FIG. 14 is an exploded perspective view of a crankshaft according to Embodiment 3.

Since the engine in embodiment 3 only differs from embodiment 1 with respect to the divided construction of the crankshaft 1 in the engine E of embodiment 1, descriptions will be given on only the composition of such differences. As shown in FIG. 14, the crankshaft 1B consists of divided body 1X and divided body 1Y. Divided body 1X is composed of a crankpin 1*a*, a crank journal 1*b*, a crank arm 1*c*, a crankshaft portion 1*d*, a counter weight 1*e*, a spline shaft part 1*f*, and a protrusion 1*g* having square shaped cross section protruding from the divided end surface of crankpin 1*a*.

The other divided body 1Y is composed of a crank journal 1*b*, a crank arm 1*c*, a crankshaft portion 1*d*, a counter weight 1*e*, a spline shaft part 1*f*, and a concave part 1*h* formed to the crank arm 1*c* and which can engage tightly with the protrusion 1*g*. The crankshaft 1B is integrally coupled by engaging the protrusion 1*g* to the concave part 1*h* and securing with bolts or pins not shown in the drawing. Divided bodies 1X and 1Y cab be formed by forging or constructed with metal casting using ductile cast iron.

Embodiment 4

Figure 15:
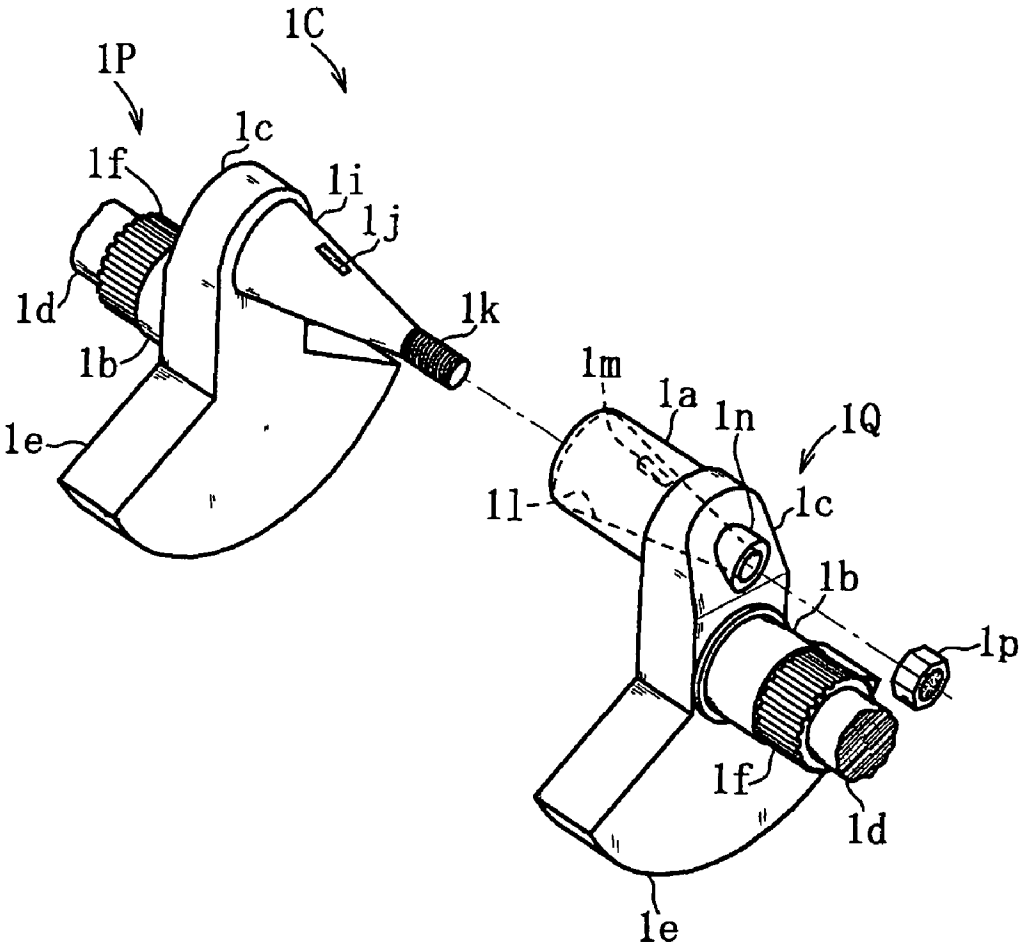
FIG. 15 is an exploded perspective view of a crankshaft according to Embodiment 4.

Since the engine of embodiment 4 only differs from embodiment 1 with respect to the divided construction of the crankshaft 1 in the engine E of embodiment 1, descriptions will be given on only the composition of such differences. As shown in FIG. 15, the crankshaft 1C is composed of divided body 1P and divided body 1Q. A divided body 1P comprises a crank journal 1*b*, a crank arm 1*c*, a crankshaft portion 1*d*, a counter weight 1*e*, a spline shaft part 1*f*, a cone-shaped protrusion 1*i* that protrudes from the inner surface of the crank arm 1*c*, a groove 1*j* formed on the midway of protrusion 1*i*, and a screw portion 1*k* formed at the tip of protrusion 1*i*.

The other divided body 1Q comprises a crankpin 1*a*, crank journal 1*b*, a crank arm 1*c*, a crankshaft portion 1*d*, a counter weight 1*e*, a spline shaft part 1*f*, a concave part 1*l* formed in the inner part of the crankpin 1*a* and which can engage with the protrusion 1*i*, a protrusion 1*m* protruding from the inner periphery of the concave part 1*l* and which can engage with the groove 1*j*, a nut fitting part 1*n* protruding from the outer surface of the crank arm 1*c* and through which the screw portion 1*k* can penetrate, and a nut 1*p*. Divided body 1P and divided body 1Q are coupled so that the protrusion 1*m* engage with the groove 1*j*, and the crankshaft 1*e* is integrally assembled by fastening the nut 1*p* to the screw 1*k* that penetrates the nut fitting part 1*n*.

Next, descriptions will be given hereafter regarding modified examples which partially modify the embodiments given hereinabove.

1) With embodiment 1, descriptions are given of en example of a vertical type vertically opposed engine, but the engine E may also be suitably constructed as a horizontally opposed engine with the cylinder bores B1 and B2 directed to the horizontal direction and the output shaft 16 directed to the vertical direction, or constructed as a horizontally opposed engine with the cylinder bores B1 and B2 directed to the horizontal direction and the output shaft directed to the horizontal direction. In addition, construction is possible of a two cylinder horizontally opposed engine, a single cylinder engine, or multi-cylinder engine, which arrange the cylinder bores only on one side of the crankshaft.

2) The output taking out mechanism T of engine E of embodiment 1 comprises a construction with left right symmetry as shown in FIG. 3 with respect to the crankpin 1*a* of the crankshaft 1. However, composing the engine with a left right asymmetry construction is also acceptable. In other words, composing the engine with a construction that, for example, as shown in the left half of FIG. 3, omits the crankshaft portion 1*d*, pinion member 20, internal gear member 19, and output member 17 etc., and a journal support member 17*a* having bearings b3 may be provided at the left half.

3) Descriptions are given in embodiment 1 of an example in which a journal support member 17*a* and output member 17 are coupled integrally by a balancer weight 17*c*. However, a construction in which the balancer weight 17*c* is omitted and divides the journal support member 17*a* and the crankshaft support portion 17*b* is also acceptable, and, in this example, the balancer weight 17*c* may also be integrally provided to any one of the journal support member 17*a* and the output member 17.

4) The valve driving mechanism VD of embodiment 1 is just one example, and various valve driving mechanisms may be adopted.

5) Other modes or structures will be possible for a person skilled in the art by adding various modifications to the present embodiment without departing from the essence of the present invention, and the present invention includes these types of modified forms.

The present invention provides an internal combustion engine that takes out rotational power from the output shaft by converting reciprocating rectilinear motion of pistons to rotational motion of a crankshaft, and particularly provides an internal combustion engine with a structure so as to limit the locus of motion of a crankpin of a crankshaft to the same reciprocating rectilinear motion as a piston through a pinion member and an internal gear member.

What is claimed is:

1. An internal combustion engine, comprising a piston capable of sliding within a cylinder bore and a crankshaft coupled operatively through a connecting member to the piston, and capable of converting reciprocating motion of the piston into rotational motion of the crankshaft to output rotational power from an output shaft supported by a case member, wherein; the crankshaft comprises a crankpin coupled to the connecting member, a pair of crank arms and a pair of counter weights, a pair of crank journals, and at least one crankshaft portion which extends coaxially from at least one crank journal; and said internal combustion engine, further comprises: at least one output member supporting the crankshaft rotatably around a rotary axial center off-centered from an axial center of the output shaft and being formed integrally with the output shaft and supported by a case member rotatably coaxially with the output shaft; at least one internal gear member having a plurality of internal gear teeth formed coaxially with the output member and being fixed to the case member; at least one pinion member having an outer diameter equal to ½ of an inner diameter of the internal gear member and engaging so as to be capable of rolling along an inner periphery of the internal gear member, said pinion member being fitted externally on the crank shaft portion rotatably integrally with the crankshaft portion in a position adjacent to the crank journal; and a pair of journal support members having respective bearings to support a pair of crank journals rotatably around an axial center off-centered from the axial center of the output shaft and being supported by the case member rotatably coaxially with the output member; and said internal combustion engine converting the reciprocating motion of the piston into rotation and revolution of the pinion member, and converting the revolution of the pinion member into rotation of the output member to be output as rotational power from the output shaft.

2. The internal combustion engine according to claim 1, wherein the crankpin moves with reciprocating rectilinear motion parallel to the axial center of the cylinder bore when the piston reciprocates within the cylinder bore.

3. The internal combustion engine according to claim 2, wherein the internal combustion engine has a plurality of cylinder bores and pistons arranged in an opposing manner on both sides of the crankshaft, and a plurality of connecting members coupled respectively with a plurality of pistons are integrally formed.

4. The internal combustion engine according to claim 3, wherein the connecting member has a ring-shaped connector externally mounted rotatably on the crankpin, and a plurality of straight connectors coupled to the plurality of pistons; and at least a portion of the straight connectors among the plurality of straight connectors is fixed to the ring-shaped connector.

5. The internal combustion engine according to claim 3, wherein the plane that includes the center line of the plurality of pistons is arranged orthogonal to the crankpin.

6. The internal combustion engine according to claim 3, wherein plane that includes center lines of the plurality of pistons is arranged parallel to an axial center of the crankpin.

7. The internal combustion engine according to claim 3, wherein a balancer weight is integrally equipped to the output member.

8. The internal combustion engine according to claim 3, wherein an off-centering amount of the crankpin in relation to the crankshaft portion is set to ½ of an outer diameter of the pinion member.

9. The internal combustion engine according to claim 1, wherein said output member comprising a bearing supporting rotatably the crank shaft portion at an opposite position from the journal support member in relation to the internal gear member, said journal support member comprising a bearing supporting rotatably the crank journal positioned between the crank arm and the pinion member.

10. The internal combustion engine according to claim 3, wherein the balancer weight is formed at the opposite side from the pinion member in relation to the axial center of the output shaft in the inner space of the internal gear member.

11. The internal combustion engine according to claim 4, wherein a balancer weight is integrally equipped to the output member.

12. The internal combustion engine according to claim 5, wherein a balancer weight is integrally equipped to the output member.

13. The internal combustion engine according to claim 6, wherein a balancer weight is integrally equipped to the output member.

14. The internal combustion engine according to claim 4, wherein an off-centering amount of the crankpin in relation to the crankshaft portion is set to ½ of an outer diameter of the pinion member.

15. The internal combustion engine according to claim 5, wherein an off-centering amount of the crankpin in relation to the crankshaft portion is set to ½ of an outer diameter of the pinion member.

16. The internal combustion engine according to claim 6, wherein an off-centering amount of the crankpin in relation to the crankshaft portion is set to ½ of an outer diameter of the pinion member.

17. The internal combustion engine according to claim 4, wherein the balancer weight is formed at the opposite side from the pinion member in relation to the axial center of the output shaft in the inner space of the internal gear member.

18. The internal combustion engine according to claim 5, wherein the balancer weight is formed at the opposite side from the pinion member in relation to the axial center of the output shaft in the inner space of the internal gear member.

19. The internal combustion engine according to claim 6, wherein the balancer weight is formed at the opposite side from the pinion member in relation to the axial center of the output shaft in the inner space of the internal gear member.

* * * * *